US005596823A

United States Patent [19]

Clasen et al.

[11] Patent Number: 5,596,823

[45] Date of Patent: Jan. 28, 1997

[54] HYDRAULIC SYSTEM FOR A DOUBLE ACTING CYLINDER

[75] Inventors: Dennis R. Clasen, Wamego; Don H. Kleiner, Manhattan, both of Kans.

[73] Assignee: Caterpillar Inc., Peoria, Ill.

[21] Appl. No.: 571,324

[22] Filed: Dec. 12, 1995

[51] Int. Cl.[6] ..... F15B 1/02; E01H 5/04

[52] U.S. Cl. ..... 37/232; 37/236; 60/413

[58] Field of Search ..... 37/236, 237, 281, 37/232; 172/793, 796, 799; 280/707, 709, 714; 60/413, 414, 416, 469

[56] References Cited

U.S. PATENT DOCUMENTS

| | | | |
|---|---|---|---|
| 2,750,688 | 6/1956 | Grabow | 37/281 X |
| 3,561,541 | 2/1971 | Woelfel | 172/265 |
| 3,800,903 | 4/1974 | Beals et al. | 180/79.2 B |
| 3,872,670 | 3/1975 | Dezelan et al. | 60/413 |
| 4,834,191 | 5/1989 | Vecchio | 172/784 |
| 5,083,811 | 1/1992 | Sato et al. | 280/707 |
| 5,177,887 | 1/1993 | McGugan et al. | 37/236 |

OTHER PUBLICATIONS

Caterpillar service publication "Hydraulic Snow Wings for CAT Motor Graders"—using Balderson Hydraulic Snow Wing, Form No. CM5060, 1994.

*Primary Examiner*—Henry E. Raduazo
*Assistant Examiner*—Robert Pezzuto
*Attorney, Agent, or Firm*—O. Gordon Pence

[57] ABSTRACT

A hydraulic system includes a double acting hydraulic cylinder for suitably supporting a snow wing on an articulated motor grader in a fixed roading position. The hydraulic system is provided with a pressure relief circuit that permits the motor grader to be articulated without manual adjustment of the hydraulic pressure in the hydraulic cylinder.

3 Claims, 1 Drawing Sheet

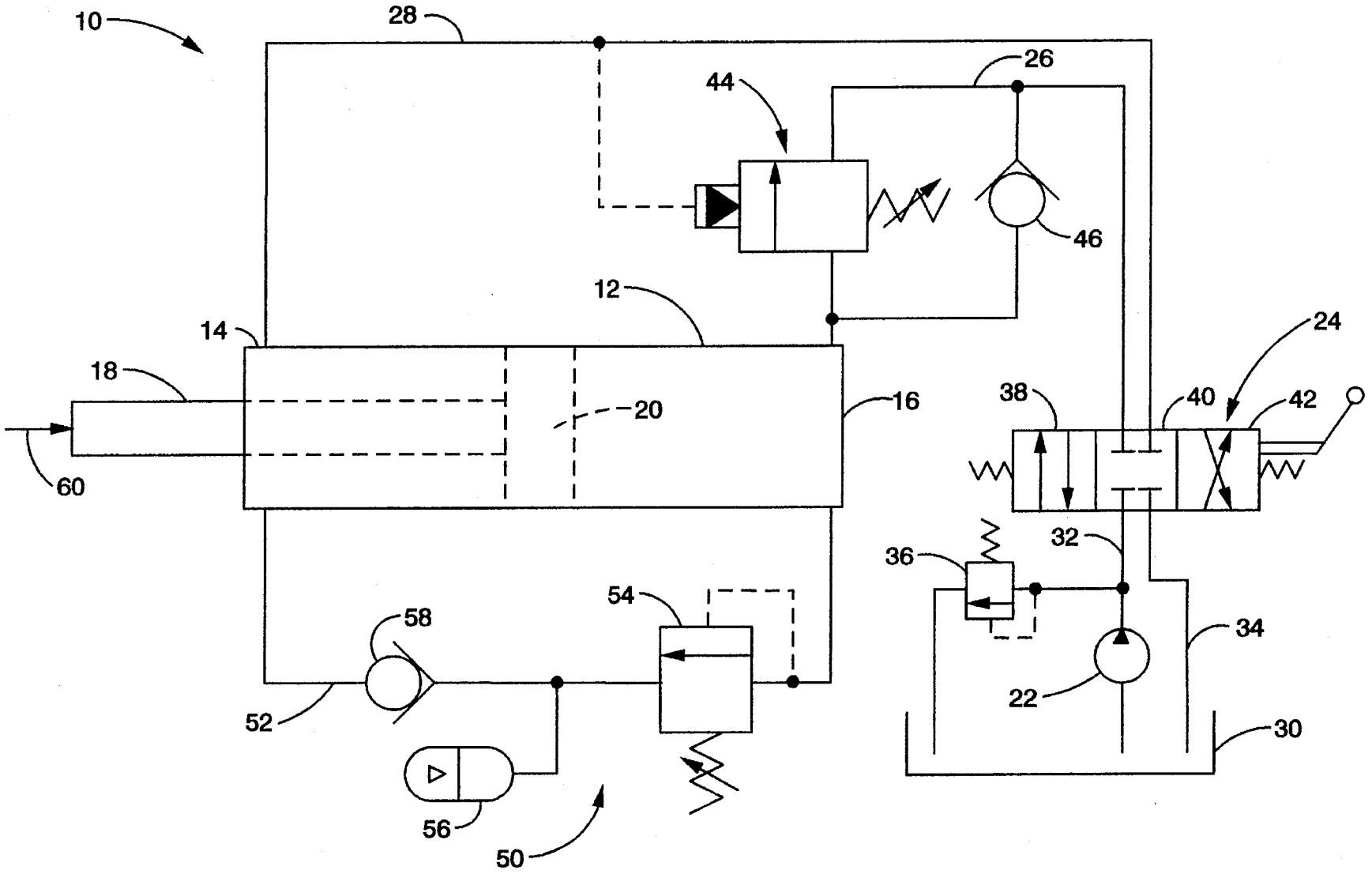
10
12
14
16
18
20
22
24
26
28
30
32
34
36
38
40
42
44
46
50
52
54
56
58
60

HYDRAULIC SYSTEM FOR A DOUBLE ACTING CYLINDER

TECHNICAL FIELD

The present invention relates generally to a pressure relief circuit for a hydraulic system which controllably transfers fluid from the head end of a hydraulic cylinder to the rod end in response to the pressure in the head end exceeding a predetermined magnitude.

BACKGROUND ART

The motor grader is a very versatile vehicle, which is capable of being adapted with numerous production work implements. Motor graders have steerable front wheels for turning. Because of their length, motor graders have relatively large turning radiuses. An articulated motor grader has a front frame portion that is pivotally connected to a rear frame portion about a vertical axis. The pivotable frame portions are used to provide the articulated motor grader with a tighter turning radius to make it more maneuverable.

Motor graders have long been used for removing snow from roads and other paved surfaces. The center moldboard or snow plow, located behind the front wheels and ahead of the operator's cab on the motor grader is angled in use to cast the snow to one side. Normally, the snow is cast to the right side to place the snow removed from the traffic lane onto the shoulder of the highway being plowed. As a result, high banks of snow can be built up on the shoulder of the road. To alleviate this problem, motor graders can be equipped with an auxiliary snow wing. The snow wing has a second snow plow or snow wing moldboard. The snow wing moldboard typically extends from the right side of the motor grader at an angle to cast snow on the shoulder further to the right to remove it from the edge of the adjacent lane of traffic.

Because the snow wing moldboard extends well beyond the side of the motor grader when in its plowing position, it is necessary to bring the snow wing moldboard in close to the motor grader to permit the motor grader to travel from place to place when not plowing snow. A boom arrangement is typically used to raise and lower the moldboard and to maintain the snow wing moldboard in a fixed roading position close to the side of the motor grader. The forward or leading edge of the snow wing moldboard is located adjacent the trailing right hand end of the center moldboard, which places it along the front frame portion of the articulated motor grader. The rearward trailing end of the snow wing moldboard, on the other hand, is located toward the rear of the motor grader, which places it along the rear frame portion. As a consequence, the leading end of the snow wing is connected to the front frame portion, while the trailing end is connected to the rear frame portion of the motor grader. As those skilled will appreciate, the distance from the connection of snow wing on the front frame portion and the connection on the rear frame portion increases in length when the motor grader articulates to the left.

In prior snow wings, a problem occurs when the motor grader was articulated to the left to make a left-hand turn because of this increase in distance between the front connection and the rear connection. As this distance increases, a downward force is exerted on the boom. As the boom is raised and lowered by a double acting hydraulic cylinder, this force is likewise exerted on the hydraulic cylinder in a direction tending to collapse the cylinder. In order to prevent damage to the snow wing or other components, the operator of the motor grader must be cognizant of this force build-up and continually correct the adjustment of the cylinder as required while the motor grader is being articulated.

The present invention is directed to overcome the problems encountered with the prior snow wing support mechanism by providing a hydraulic system having a pressure relief circuit to prevent the creation of a high force acting to collapse the hydraulic cylinder.

DISCLOSURE OF THE INVENTION

In one aspect of the invention, a hydraulic system is provided for raising and lowering a snow wing of an articulated motor grader and for maintaining the snow wing in a fixed roading position. The hydraulic system includes a manual control valve and a double acting hydraulic cylinder having a rod end and a head end. The hydraulic cylinder is disposed at a remote location from the valve and has a first line connecting the head end of the hydraulic cylinder to the valve and a second line connecting the rod end of the cylinder to the valve. The hydraulic system is provided with a pressure relief circuit for relieving pressure in the head end of the hydraulic cylinder when the cylinder is subjected to a high force tending to collapse the cylinder. The relief circuit includes a third line connecting the head end of the hydraulic cylinder to the rod end thereof. A relief valve disposed in the third line is responsive to pressure from the head end of the hydraulic cylinder. The relief circuit also includes an accumulator that is connected to the third line between the relief valve and the rod end of the hydraulic cylinder.

BRIEF DESCRIPTION OF THE DRAWING

The FIGURE is a schematic diagram of a hydraulic system embodying the features of the present invention.

BEST MODE FOR CARRYING OUT THE INVENTION

Referring more particularly to the drawing, a hydraulic system 10 embodying the principles of the present invention is disclosed. Such hydraulic system 10 is utilized in association with a boom (not shown) for raising and lowering a snow wing of an articulated motor grader. As the articulated motor grader itself and the other components of the snow wing are well known in the art and may be of any conventional construction, they are not described or shown and will only be referred to herein to the extent needed to appreciate the problems encountered in prior snow wings and to understand the applicability of the present invention.

The hydraulic system 10 includes a double acting hydraulic cylinder 12 for raising and lowering the snow wing moldboard as discussed above, but that relieves the pressure in the hydraulic cylinder to prevent damage to the cylinder 12 or other components of the snow wing.

The hydraulic cylinder 12 has a rod end 14 and a head end 16. A rod 18 extends from the rod end 14 and is connected to a piston 20, which is reciprocatably mounted within the cylinder 12. While not necessary for the operation of the invention and therefore not shown, the rod 18 is typically connected to the boom of the snow wing in any suitable manner, while the head end 16 of the hydraulic cylinder 12 is connected in any suitable manner to the front frame portion of the motor grader.

The hydraulic system 10 also includes a pump 22, a manual three position control valve 24, a first line 26 connecting the valve 24 to the head end 16 of the cylinder 12 and a second line 28 connecting the valve 24 to the rod end 14 of the cylinder 12. The pump 22 is connected to a tank 30 and is adapted to supply pressurized hydraulic fluid from the tank 30 to the valve 24 through a pressure line 32. A drain line 34 is connected to the valve 24 to return hydraulic fluid to the tank 30. A main relief valve 36 may be connected to the pressure line 32 between the pump 22 and the valve 24 and responsive to pump pressure to dump fluid to the tank 30 when pressure exceeds a predetermined level. For example, a main relief pressure setting of 3,500 p.s.i. has been used with satisfactory results. The valve 24 has a first position 38 in which the pump 22 is connected to the first line 26 and the second line 28 is connected to tank 30, a second position 40 in which the first and second lines 26,28, pressure line 32 and drain line 34 are all blocked, and a third position 42 in which the second line 28 is connected to the pump 22 and the first line 26 is connected to tank 30.

Those skilled in the art will appreciate that the valve 24 is located in the operator's cab (not shown), while the hydraulic cylinder 12 is located at the snow wing boom, which places the cylinder 12 remotely and some distance away from the valve 24. Because of this remoteness, the hydraulic system 10 is preferably provided with a counterbalance valve 44 that is located adjacent the hydraulic cylinder 12. Such counterbalance valve 44 is connected to the first line 26 adjacent the head end 16 of the hydraulic cylinder 12 and is responsive to fluid pressure to the rod end 14 of the hydraulic cylinder 12 via connection to the second line 28. A check valve 46 is placed in parallel with the counterbalance valve 44 to permit the flow of fluid to the head end 16 of the hydraulic cylinder 12, but block the flow of fluid from the head end 16.

In accordance with the present invention, the hydraulic system 10 includes a pressure relief circuit 50 for relieving pressure in the head end 16 of the hydraulic cylinder 12 when the cylinder 12 is subjected to high forces tending to collapse the cylinder 12 or in the direction depicted by arrow 60. The relief circuit 50 includes a third line 52 connected between the head end 16 and the rod end 14 of the hydraulic cylinder 12 and a cross-port relief valve 54 disposed in the third line 52 and responsive to pressure from the head end 16 of the hydraulic cylinder 12. The pressure relief circuit 50 also includes an accumulator 56 connected to the third line 52 between the relief valve 54 and the rod end 14 of the hydraulic cylinder 12. A check valve 58 is also disposed in the third line 52 between the accumulator 56 and the rod end 14 of the hydraulic cylinder 12.

INDUSTRIAL APPLICABILITY

The construction of the present hydraulic system 10 is effective in relieving pressure in the head end 16 of the double acting hydraulic cylinder 12 when the hydraulic cylinder 12 is subjected to a high force tending to collapse the hydraulic cylinder 12. As previously mentioned, such a high force can be exerted on the hydraulic cylinder 12 in the direction of arrow 60 when the articulated motor grader in which the hydraulic system 10 is employed is articulated to the left when making a left-hand turn. Those skilled in the art will appreciate that a force on the rod 18 tending to collapse the hydraulic cylinder 12 builds up fluid pressure in the head end 16 of the hydraulic cylinder 12 when the control valve 24 is closed (in the second position 40) because fluid cannot escape from the hydraulic cylinder 12.

In operation, the manual control valve 24 is moved by the operator to the first position 38 to direct pressurized fluid to the rod end 14 of the hydraulic cylinder 12 to lower the snow wing to its operative snow plowing position by causing the hydraulic cylinder 12 to retract. When the operator desires to raise the snow wing, he moves the valve 24 to its third position 42, which communicates pressurized fluid to the head end 16 of the hydraulic cylinder 12. This causes the hydraulic cylinder 12 to extend and raise the snow wing to its stored position. Once the snow wing is raised, the valve 24 is moved to its second position 40, where both the head and rod ends 16,14 of the hydraulic cylinder 12 are blocked so as to maintain the hydraulic cylinder 12 in a fixed position.

If the operator then articulates the motor grader to the left when the snow wing is in its stored position, a high force is created. Such force is exerted on the hydraulic cylinder 12, which tends to collapse the hydraulic cylinder 12, as previously described. Because the fluid is prevented from escaping from the head end, the hydraulic cylinder 12 cannot collapse and pressure in the head end 16 may increase dramatically. As a result of not being relieved, the force may continue to increase until some component of the snow wing breaks or otherwise gives way.

With the incorporation of the pressure relief circuit 50 of the present invention, pressure in the head end 16 of the hydraulic cylinder 12 is released by the cross port relief valve 54 if the pressure exceeds a predetermined pressure. Such predetermined pressure is selected to be at or above the operating pressure of the hydraulic system 10. For example, a cross port relief valve setting of 4,000 p.s.i. has been used with satisfactory results with an operating pressure of 3,500 p.s.i. as set by the main relief valve 36.

As pressure exceeds the cross port relief valve setting, the valve 54 opens to direct fluid from the head end 16 to the rod end 14 through third line 52. It should be appreciated that the rod end 14 has less fluid capacity per unit of travel of the piston 20 than the head end 16 has. As a result, the rod end 14 is not capable of receiving the entire quantity of fluid that is released from the head end 16. The excess amount of fluid is received into and stored by the accumulator 56. Such accumulator 56 is provided with sufficient capacity to accommodated any excess fluid expelled from the head end 16 as the result of several left-hand turns. The check valve 58 allows fluid to flow from the accumulator 56 or the head end 16, but prevent flow in the opposite direction. Therefore, pressure to the rod end 14 from the control valve 24 does not pressurize the accumulator 56.

To lower the snow wing, the control valve 24 is moved to its third position 42 so as to direct pressurized fluid to the rod end 14 of the hydraulic cylinder 12 to cause the hydraulic cylinder to retract. It should be appreciated, however, that the weight of the snow wing is supported by the hydraulic cylinder 12. When the valve is moved to its third position, the head end 16 of the hydraulic cylinder is connected to tank, which could result in the sudden drop of the snow wing. The counterbalance valve 44, however, is effective in preventing this sudden drop by preventing the release of fluid from the head end 16 unless a predetermined pressure is present in the second line 28. This predetermined pressure is below the main pressure setting of the main relief valve 36. For example, a counterbalance valve pressure setting of 2,500 p.s.i. has been used with satisfactory results.

When the control valve 24 is moved back to its first position 38 when the accumulator 56 is holding a charge of fluid from the head end 16 of the hydraulic cylinder 12, the rod end 14 is connected to the tank. When this happens, the fluid charge in the accumulator 56 is released through the rod end 14 as well via third line 52. As a result, the relief circuit is reset and ready for the next occurrence of a left-hand articulation of the motor grader.

Other aspects, objects, and advantages become apparent from a study of the specification, drawings, and appended claims.

We claim:

1. In a hydraulic system for raising and lowering a snow wing of an articulated motor grader and for maintaining the snow wing in a fixed roading position, the hydraulic system including a manual control valve and a double acting hydraulic cylinder having a rod end and a head end, the hydraulic cylinder being disposed at a remote location from the valve and having a first line connecting the head end of the hydraulic cylinder to the valve and a second line connecting the rod end of the cylinder to the valve, the improvement comprising:

a pressure relief circuit for relieving pressure in the head end of the hydraulic cylinder when the cylinder is subjected to a high force tending to collapse the cylinder, the relief circuit including a third line connecting the head end of the hydraulic cylinder to the rod end thereof, a relief valve disposed in the third line and responsive to pressure from the head end of the hydraulic cylinder, and an accumulator connected to the third line between the relief valve and the rod end of the hydraulic cylinder.

2. The hydraulic system of claim 1 including:

a check valve disposed within the third line between the accumulator and the rod end of the hydraulic cylinder.

3. The hydraulic system of claim 2 including:

a counterbalance valve disposed in the first line adjacent the head end of the hydraulic cylinder, the counterbalance valve being responsive to pressure from the rod end of the hydraulic cylinder.

* * * * *